US006877840B2

(12) United States Patent
Vitello et al.

(10) Patent No.: US 6,877,840 B2
(45) Date of Patent: Apr. 12, 2005

(54) FLUID-EJECTION ASSEMBLY

(75) Inventors: Christopher Vitello, Corvallis, OR (US); Silam J. Choy, Corvallis, OR (US); Terry M. Lambright, Corvallis, OR (US); Mark D. Tucker, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 84 days.

(21) Appl. No.: 10/427,167

(22) Filed: Apr. 30, 2003

(65) Prior Publication Data

US 2004/0218010 A1 Nov. 4, 2004

(51) Int. Cl.[7] ..... B41J 2/14; B41J 2/16
(52) U.S. Cl. ..... 347/50
(58) Field of Search ..... 347/49, 50, 58

(56) References Cited

U.S. PATENT DOCUMENTS 4,806,106 A 2/1989 Mebane et al.
5,422,667 A 6/1995 Daggs et al.
5,442,384 A 8/1995 Schantz et al.
5,442,386 A 8/1995 Childers et al.
5,903,295 A 5/1999 Swanson et al.
6,281,914 B1 * 8/2001 Hiwada et al. ..... 347/50
6,322,200 B1 11/2001 Feinn et al.
6,325,491 B1 12/2001 Feinn
6,338,550 B1 1/2002 Amano et al.
6,345,887 B1 2/2002 Sato
6,361,160 B1 3/2002 Feinn et al.
6,619,785 B1 * 9/2003 Sato ..... 347/50
2002/0024551 A1 2/2002 Saito
2003/0035027 A1 2/2003 Vander Plas et al.

FOREIGN PATENT DOCUMENTS

EP 0666174 9/1995

* cited by examiner

*Primary Examiner*—Thinh Nguyen

(57) ABSTRACT

A fluid-ejection assembly that includes a substantially-rigid substrate and an ejection head configured to be positioned in a fixed relationship relative to the substantially-rigid substrate. The ejection head is configured to eject a fluid based on an ejection signal received via a conductive pattern defined on the substrate.

33 Claims, 4 Drawing Sheets

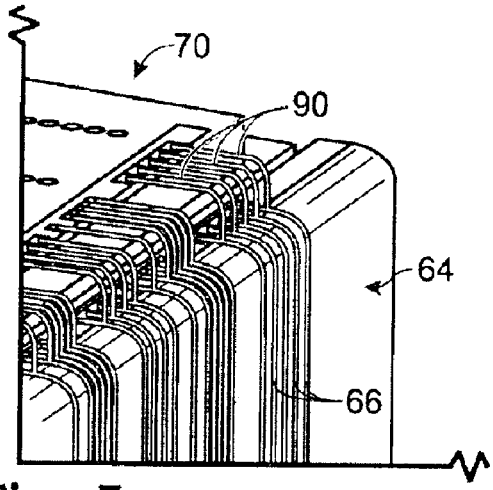
Fig. 5
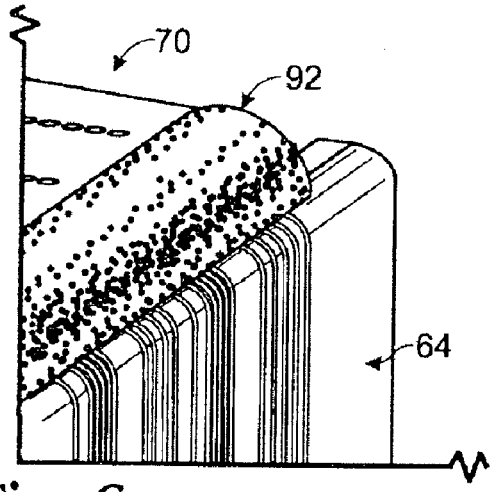
Fig. 6
Fig. 7
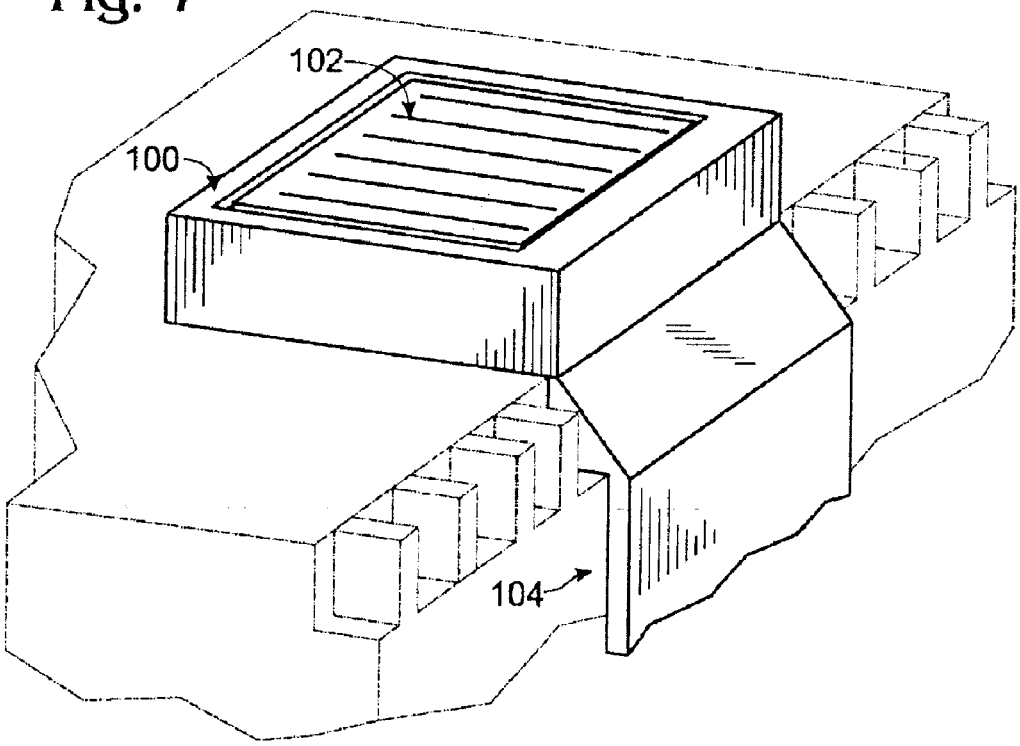

FLUID-EJECTION ASSEMBLY

BACKGROUND

Fluid-ejection systems, such as inkjet printers, are often used to produce physical reproductions of images electronically stored as digital data on a computing device. In order to create such reproductions, the fluid-ejection system precisely aims fluid, such as ink, onto a medium. An increase in the level of control over fluid ejection generally corresponds to an increase in the quality of image reproduction, thus making a fluid-ejection system more desirable. In addition to the performance of a fluid-ejection system, size, cost, and reliability are important design considerations. Therefore, fluid-ejection systems capable of producing high quality images in a reliable manner at minimal expense are desired.

SUMMARY

A fluid-ejection assembly is provided, which includes a substantially-rigid substrate and an ejection head configured to be positioned in a fixed relationship relative to the substantially-rigid, substrate. The ejection head is configured to eject a fluid based on an ejection signal received via a conductive pattern defined on the substrate.

BRIEF DESCRIPTION OF THE DRAWINGS

FIG. 5 is a somewhat schematic view of one embodiment of an electrical interface between a fluid-ejection head and a conductive pattern defined on a substantially-rigid, nonconductive substrate.

FIG. 6 is a somewhat schematic view of a shield for protecting the electrical interface of FIG. 5 from degenerative substances.

FIG. 7 is an isometric view of one embodiment of a fluid-ejection assembly incorporating an overmolding for protecting portions of the assembly from degenerative substances.

DETAILED DESCRIPTION

Figure 1:
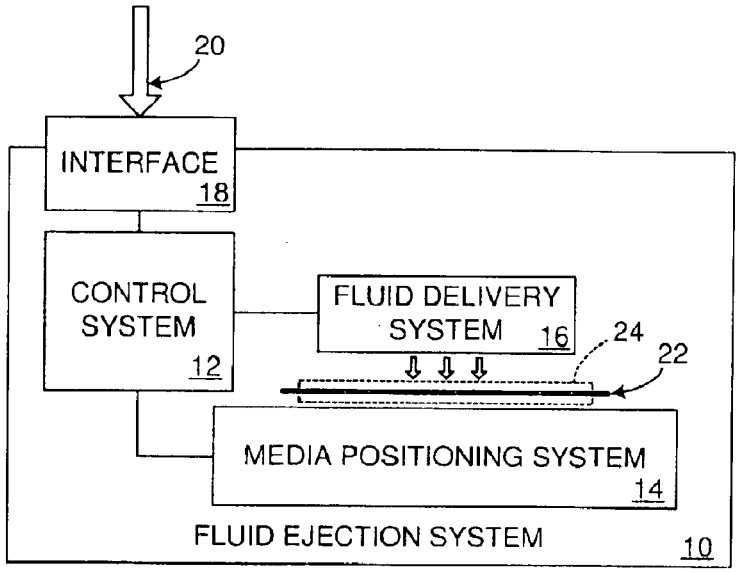
FIG. 1 is a schematic view of one embodiment of a fluid-ejection system configured to eject fluid onto a medium according to instructions received in the form of a control signal.

FIG. 1 schematically shows a fluid-ejection system 10. Although fluid-ejection systems may be configured to eject a variety of different fluids onto a corresponding variety of different media in various embodiments, this disclosure focuses on an exemplary printing system that is used to eject, or print, ink onto a print medium, such as paper. However, it should be understood that other printing systems as well as fluid-ejection systems designed for nonprinting applications, may also incorporate the ideas set forth below.

Fluid-ejection system 10 includes a control system 12, a media positioning system 14, a fluid delivery system 16, and an interface 18. Control system 12 may include componentry, such as a printed circuit board, processor, memory, application specific integrated circuit, etc., which effectuates fluid ejection corresponding to a received fluid-ejection signal 20. Fluid-ejection signals may be received via a wired or wireless interface 18, or other suitable mechanism. The fluid-ejection signals may include instructions to perform a desired fluid ejection process. Upon receiving such a fluid-ejection signal, the control system may cause media positioning system 14 and fluid delivery system 16 to cooperate to eject fluid onto a medium 22. As one example, a fluid-ejection signal, or print signal, may include a print job defining a particular image to be printed. The control system may interpret the print job and cause fluid, such as ink, to be ejected onto paper in a pattern replicating the image defined by the print job.

Media positioning system 14 may control the relative positioning of the fluid-ejection system and a medium onto which the fluid-ejection system is to eject fluid. For example, media positioning system 14 may include a paper feed that advances paper through a printing zone 24 of the fluid-ejection system. The media positioning system may additionally or alternatively include a mechanism for laterally positioning a printhead, or similar device, for ejecting fluid to different areas of the printing zone. The relative position of the medium and the fluid-ejection assembly may be controlled, so that fluid may be ejected onto only a desired portion of the medium. In some embodiments, media positioning system 14 may be selectively configurable to accommodate two or more different types and/or sizes of media.

Figure 2:
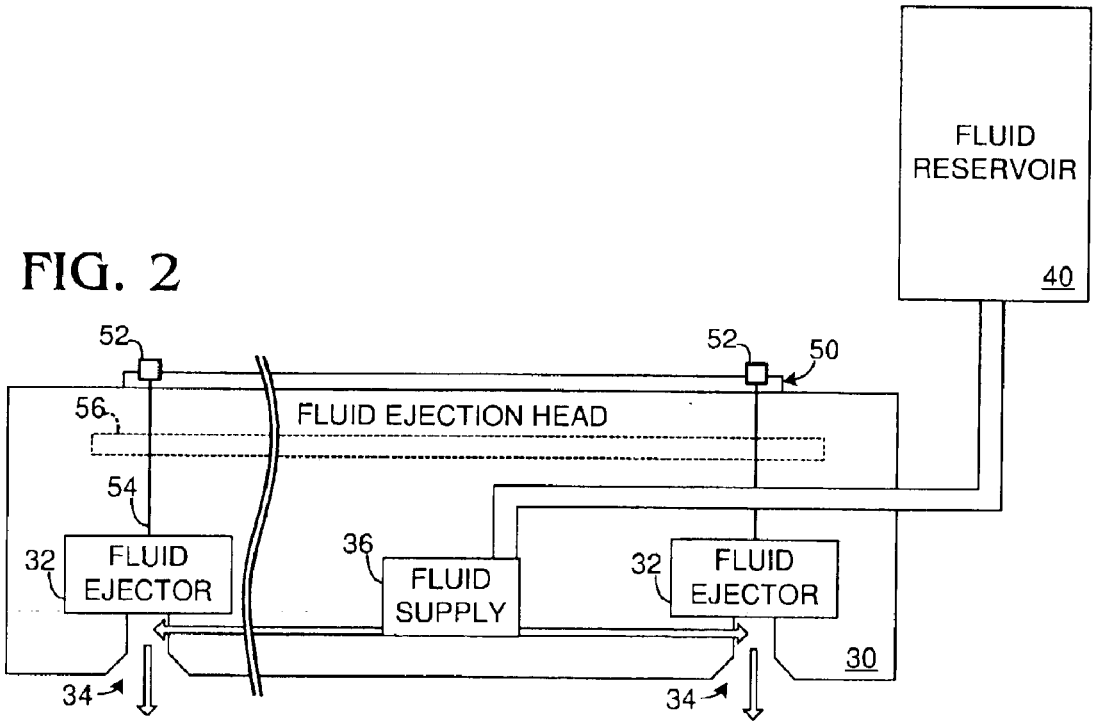
FIG. 2 is a schematic view of one embodiment of an ink delivery system including an ejection head and an off-axis fluid reservoir.

FIG. 2 schematically shows a portion of an exemplary fluid delivery assembly, which includes a fluid-ejection head 30. In the illustrated embodiment, fluid-ejection head 30 includes a plurality of fluid ejectors 32, such as semiconductor formed resistors, which correspond to a plurality of nozzles 34. The fluid-ejection head may also include a fluid supply mechanism 36 for positioning a volume of fluid in a position proximate a fluid ejector. The fluid delivery assembly may also include a fluid reservoir 40, which replenishes fluid delivered to the fluid ejectors by fluid supply mechanism 36. Fluid reservoir 40 is schematically shown as an off-axis fluid reservoir, meaning that the fluid reservoir is in fluid communication with the fluid-ejection head, but physically separated from the fluid-ejection head. On-axis reservoirs, which are physically incorporated into a fluid-ejection cartridge that includes the fluid-ejection head, are also within the scope of this disclosure. Off-axis reservoirs in an off-axis fluid delivery system may be used through one or more off-axis reservoir refills. Therefore, fluid-ejection heads used with off-axis reservoirs, or fluid-ejection heads used with on-axis reservoirs that are refilled, may be subjected to longer usage periods. Increased usage periods may subject the fluid-ejection head to increased mechanical and chemical stresses. Therefore, ink delivery system designed to better withstand such stresses may avoid an operational failure, which could render the fluid-ejection assembly inoperable.

Fluid delivered from the fluid reservoir to a fluid ejector via the fluid supply mechanism may be selectively ejected in response to an ejection signal. A portion of the fluid moved proximate a fluid ejector may be ejected through a particular nozzle when the fluid ejector associated with that nozzle is activated, such as when a resistor is heated to vaporize the fluid to create a fluid bubble. As the bubble expands, some of the fluid may be ejected out of the corresponding nozzle. When the fluid bubble collapses, a vacuum force may draw additional fluid from the fluid supply to the nozzle for subsequent ejection. In some embodiments, the fluid ejectors may include components that effectuate fluid ejection via a nonthermal mechanism, such as fluid ejectors that utilize vibration to eject fluid.

Fluid-ejection head 30 includes an electrical connector 50 for receiving electrical signals, such as from control system 12, that may be used to control the fluid ejectors. The electrical connector may include a plurality of electrical contacts 52 in electrical communication with conductive paths 54 that lead to the fluid ejectors and/or a logic subsystem 56. Logic subsystem 56 may include a plurality of logic gates including transistors and/or other circuit components for routing current to the individual fluid ejectors based on instructions received from the control system and derived from the fluid-ejection signal. Such instructions may be received via electrical connector 50 in the form of electric signals. In the case of a fluid ejector in the form of a resistor, a current conveyed through electrical connector 50 may be directed through an individual resistor, thus causing the resistor to heat the fluid proximate that resistor.

As described above, fluid-ejection head 30 may receive an ejection signal from a control system. To convey such a signal, the fluid delivery assembly may include an interconnect including one or more conductive paths electrically coupling the control system to electrical connector 50. The interconnect may alternatively or additionally provide one or more charge paths for power delivery and/or for establishing a ground connection. An interconnect may be in close proximity to degenerative substances, such as solvents, salts, water, etc., which may chemically alter the effectiveness of the interconnect. For example, ink may negatively affect an interconnect's ability to convey a signal. This may be especially true if the same interconnect is used for extended periods of time, as may be the case in off-axis fluid delivery systems, in which the same fluid-ejection head and associated interconnect may be used throughout the life of a printer. Furthermore, some interconnects may be susceptible to mechanical failure, and the likelihood of mechanical failure may increase as the period of time in which the interconnect is used increases. Interconnects that are capable of withstanding such chemical and mechanical stresses may provide increased reliability.

Interconnects often couple to components with relatively tight space tolerances. For example, a fluid-ejection head may be closely spaced relative to a medium onto which it is ejecting fluid. In some embodiments, interconnects do not interfere with reducing the spacing between a fluid-ejection head and a receiving medium. In some embodiments, spacing is reduced between adjacent components with interconnects that facilitate such a reduction. Furthermore, in another embodiment, ability to control the precise placement of an interconnect may provide greater design freedom for other parts of a fluid-ejection assembly. In this embodiment, interconnects do not change shape during use.

One type of interconnect includes flexible circuitry for routing of control signals and/or power to fluid-ejection heads. In particular, tape automated bonding (TAB) processes is used to electrically connect a fluid-ejection head with a control system. Using standard TAB processes, metal conductors are placed on a flexible polymer substrate and protected with a cover layer. By flexible, it is meant that the substrate and the associated metal conductors may be bent, flexed, or otherwise deformed. On the other hand, in one embodiment, a rigid, or nonflexible, interconnect resists such deformation, and generally remains substantially static.

Rigid interconnects may be configured to complement other components of a fluid-ejection assembly so that the interconnect may be easily incorporated into the fluid-ejection assembly. As one nonlimiting example, a rigid interconnect may be physically shaped to mate with another component, so that the interconnect follows the contour of the other component. Rigid interconnects may mechanically lock to another component, thus making an effective assembly of two or more components. The assembly may also collectively reduce space used to electrically couple the respective components of the assembly. Furthermore, because the rigid interconnect does not flex, once mated with another component, the assembly has a reduced level of mechanical stress.

Figure 3:
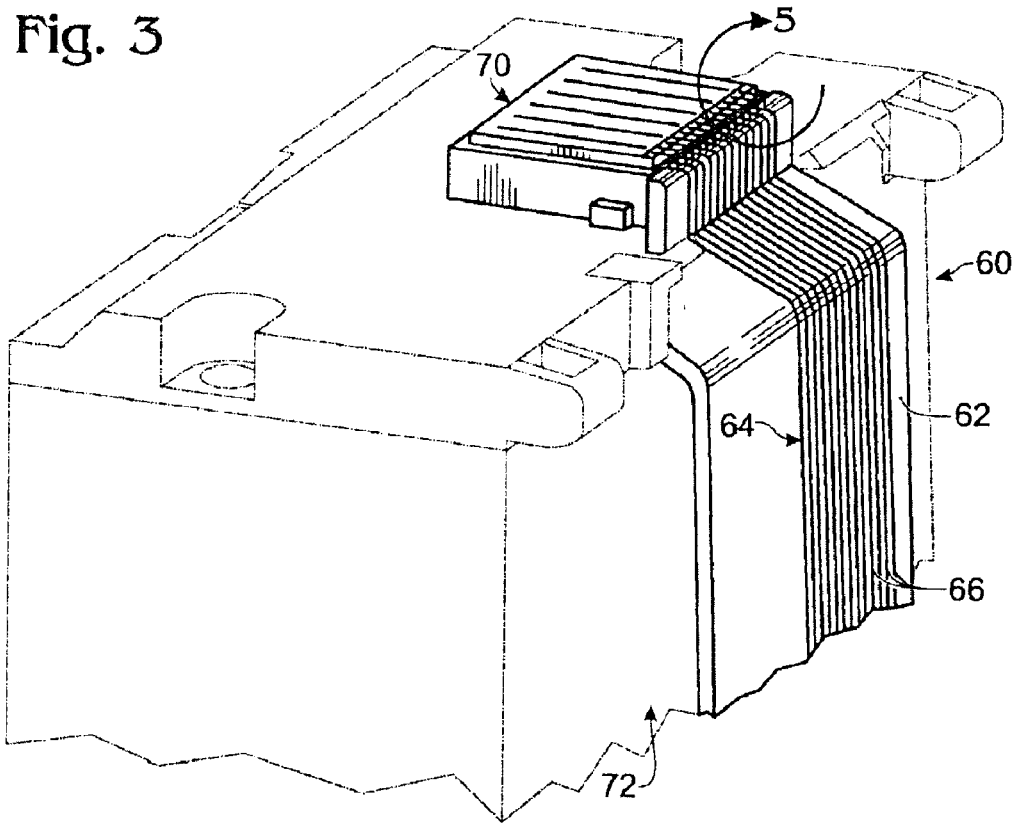
FIG. 3 is an isometric view of one embodiment of a portion of a fluid-ejection assembly, which includes an interconnect having a conductive pattern defined on a substantially-rigid, nonconductive substrate.

FIG. 3 shows an exemplary interconnect 60 in the form of a substantially-rigid substrate 62 embedded with a conductive circuit pattern 64, which includes a plurality of traces 66. As shown, interconnect 60 may be electrically coupled to a fluid-ejection head 70. Interconnect 60 may also be electrically coupled to a control system, either directly or via one or more intermediate charge paths, thus electrically connecting the fluid-ejection head and the control system. In other words, traces 66 may convey charge between the control system and the fluid-ejection head. In this manner, fluid ejectors may be selectively controlled by the control system via the conveyed signal. A rigid interconnect may additionally or alternatively be used to electrically couple different nodes of a fluid-ejection system.

In one embodiment, the substrate 62 is nonconductive and may be constructed from one or more moldable nonconductive materials, such as liquid-crystal polymer, syndiotactic polystyrene, acrylonitrile-butadiene-styrene, polycarbonate, polyphenylene oxide, Poly(phenylene sulfide), Poly (ethylene terephthalate), Poly(butylene terephthalate), Polysulfone, Polyethersulfone Polyetherimide, and/or other thermoplastics or similar materials. The nonconductive material electrically separates the individual traces from one another, while providing rigid support to the traces. In another embodiment, the substrate 62 electrically isolates the traces. Therefore, the traces may remain electrically isolated from one another, while at the same time remaining positionally fixed relative to one another. The traces may be embedded in a three-dimensional pattern, which may span one or more surfaces of the substrate. Such a three dimensional pattern may have traces that are fixed on the substrate to conform to the contour of the substrate. Furthermore, circuitry on different surfaces may be electrically linked using conductive vias and/or other substrate manipulation or simply by spanning the perimeter of the surfaces. In this manner, traces may extend across two or more parallel or nonparallel rigid surfaces, each of which may be generally planar and/or curvilinear.

Rigid interconnects may be manufactured using several different processes. For example, an interconnect may be formed by injection molding the substrate into a desired shape. Injection molding may be implemented in one or more stages, or shots, to form complex shapes. The substrate may have a conductive layer, such as an aluminum or copper layer, formed thereon. A circuit pattern may be defined on the conductive layer using a technique such as photo imaging or laser patterning. Such techniques may be used to achieve a line width and line spacing in the range of 0.001 inches to 0.025 inches, and preferably in the range of 0.001 inches to 0.005 inches, although other line widths and line spacings may be used. Depending on the chosen technique for establishing the circuit pattern, the conductive layer may be treated with a resist resin. For example, when photo imaging, a resist resin may be hardened when exposed to ultraviolet light through a photomask that defines the circuit pattern. The unhardened resin may be removed, revealing the underlying conductive layer, which may be chemically stripped, leaving conductive traces defined by the photomask.

Substrates may be molded, or otherwise formed, in virtually any desired shape. In some embodiments, a substrate may be shaped to correspond with another component of the fluid-ejection assembly so that the substrate may be positioned in a fixed relationship relative to the other component, such as by physically connecting to the component, or at least being shaped to be positioned immediately adjacent the other component. To facilitate such positioning, the substrate may be shaped to follow the contour of the other component. An example of this is shown in FIG. 3, where interconnect 60 has been shaped to mate with fluid-ejection-head carrier 72, upon which fluid-ejection head 70 is disposed. A fluid-ejection-head carrier may be formed from a plastic material or a ceramic, such as alumina, via injection molding, dry-pressing, or a similar process. Rigid substrates may be shaped to mate with components other than ejection-head carriers in some embodiments. Shaping the interconnect to correspond with the shape of another component may simplify assembly. The substrate may be secured to a corresponding component, such as via an adhesive, through a mechanical locking feature, or with swage posts which are melted to retain the substrate.

Figure 4:
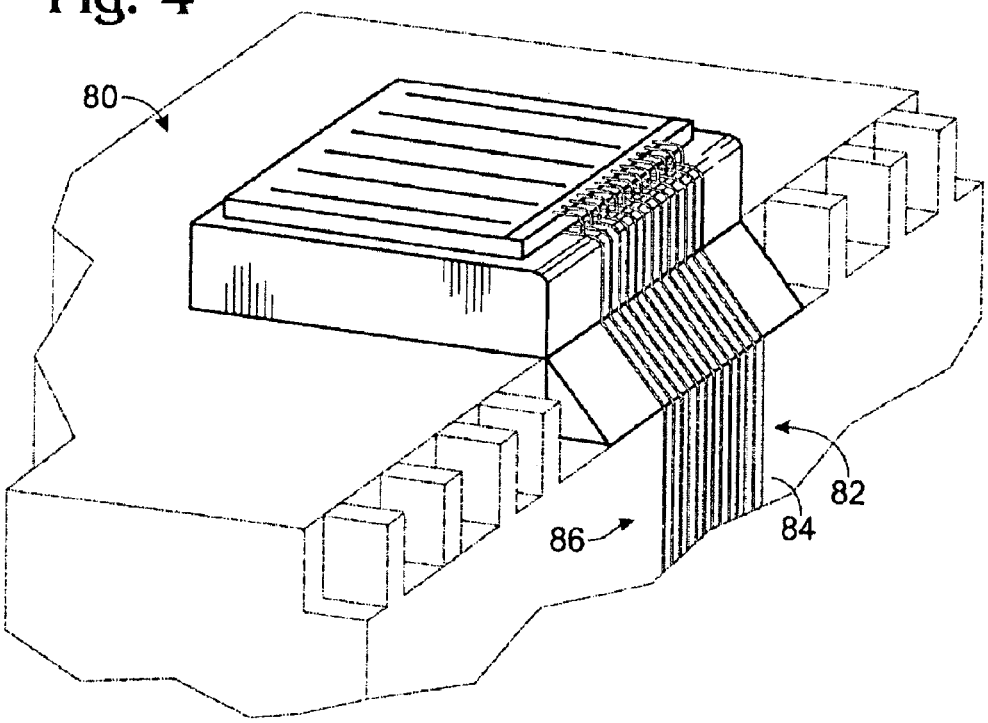
FIG. 4 is an isometric view showing one embodiment of an ejection-head carrier formed from a substantially-rigid, nonconductive substrate embedded with a conductive pattern for electrically coupling an ejection head to a control system.

In some embodiments, a nonconductive substrate may be shaped as a constituent component of a fluid-ejection assembly so that the component itself serves as an interconnect. FIG. 4 shows an example of a fluid-ejection-head carrier 80 at least partially formed from an interconnect 82 including a nonconductive substrate 84 embedded with a circuit pattern 86. In other words, nonconductive substrate 84 defines, or makes up, a portion of fluid-ejection-head carrier 80. The fluid-ejection-head carrier may serve its ordinary mechanical functions and may additionally electrically interconnect the fluid-ejection head and the control system, or other electrical node. Though illustrated as a fluid-ejection-head carrier, other components of a fluid-ejection assembly may be embedded with a circuit pattern, thus providing interconnect functionality to such components. Nonconductive substrates may be molded, or otherwise shaped, into virtually any configuration, thus permitting a great deal of design freedom for incorporating interconnect functionality into a wide range of components. Because the ability to convey an electric signal may be incorporated into traditionally mechanical components, the complexity of design may be decreased. The function of multiple components may be merged into a single component, thus simplifying assembly, reducing size, and/or reducing cost.

As shown in FIG. 5, individual traces 66 of an embedded circuit pattern 64 may be electrically coupled to a fluid-ejection head 70. In the illustrated embodiments, wire bonds 90 make the electrical connection, although other types of connectors may be used, such as TAB or other suitable connectors. In some embodiments, the nonconductive substrate may be shaped so the embedded traces themselves directly contact an electrical connector configured to make such a connection, thus eliminating an intermediate connector. Because the circuit pattern of the interconnect and the electrical connector generally do not move relative to one another, the mechanical strain placed on the connection is limited. However, due to the proximity of the connection to the fluid-ejection head and the potentially damaging fluids ejected from the head, the connection may be vulnerable to chemical attack. To limit damage from such attack, the connection may be shielded, such as by applying a coating 92 to the connection, as shown in FIG. 6. In some embodiments, an overmolding may additionally or alternatively be used to shield the connectors, as is described in more detail below.

FIG. 7 shows an overmolding 100 covering a portion of fluid-ejection head 102 and a portion of a circuit pattern of an interconnect 104. Overmoldings may be designed to shield selected portions of an interconnect, a fluid-ejection head, and/or another component of a fluid-ejection assembly. By shield, it is meant that the overmolding may create, by itself or in conjunction with a coating, sealant, and/or other material, a substantially fluid tight seal that limits a protected area from exposure to degenerative substances, such as ink. An overmolding may provide protection from degenerative substances while also providing mechanical reinforcement. Therefore, an overmolding may limit mechanical and chemical stresses that may otherwise contribute to premature failure of a fluid-ejection assembly. Overmoldings may be constructed from polymers, such as poly(ethylene terephthalate), glycol, liquid-crystal polymer, poly(phenylene sulfide), and poly(cyclohexylene dimethylene terephthalate), acid and/or other suitable materials. Such materials are usually selected for their cost, workability, and ability to provide chemical protection from degenerative substances that are likely to exist in the devices vicinity.

The size and configuration of an overmolding may be selected in order to adequately shield a given component, or group of components, from degenerative substances that are likely to be present near the shielded area. For example, a fluid-ejection head may expel fluid that can damage the fluid-ejection head and the interconnect. In particular, the charge paths, or traces, used to convey electrical signals may be damaged. Therefore, shielding such portions of those components, which are susceptible to chemical attack, may reduce the likelihood of such attack causing a premature failure. In some embodiments, other portions of a printing system may be overmolded to guard against attack from ink and/or other degenerative substances.

An overmolding may be configured to create a mechanical seal with another part, may be used in conjunction with a sealant or adhesive to enhance the bond, may be effectively welded to another component, or otherwise installed so as to create a substantially fluid tight seal for resisting chemical attack. The overmolding typically does not move relative to the component that it is protecting, and therefore mechanical stress between the overmolding and its corresponding component is negligible. On the other hand, various shields used to protect flexible interconnects may have to move and/or flex, and therefore may lose effectiveness.

Figure 8:
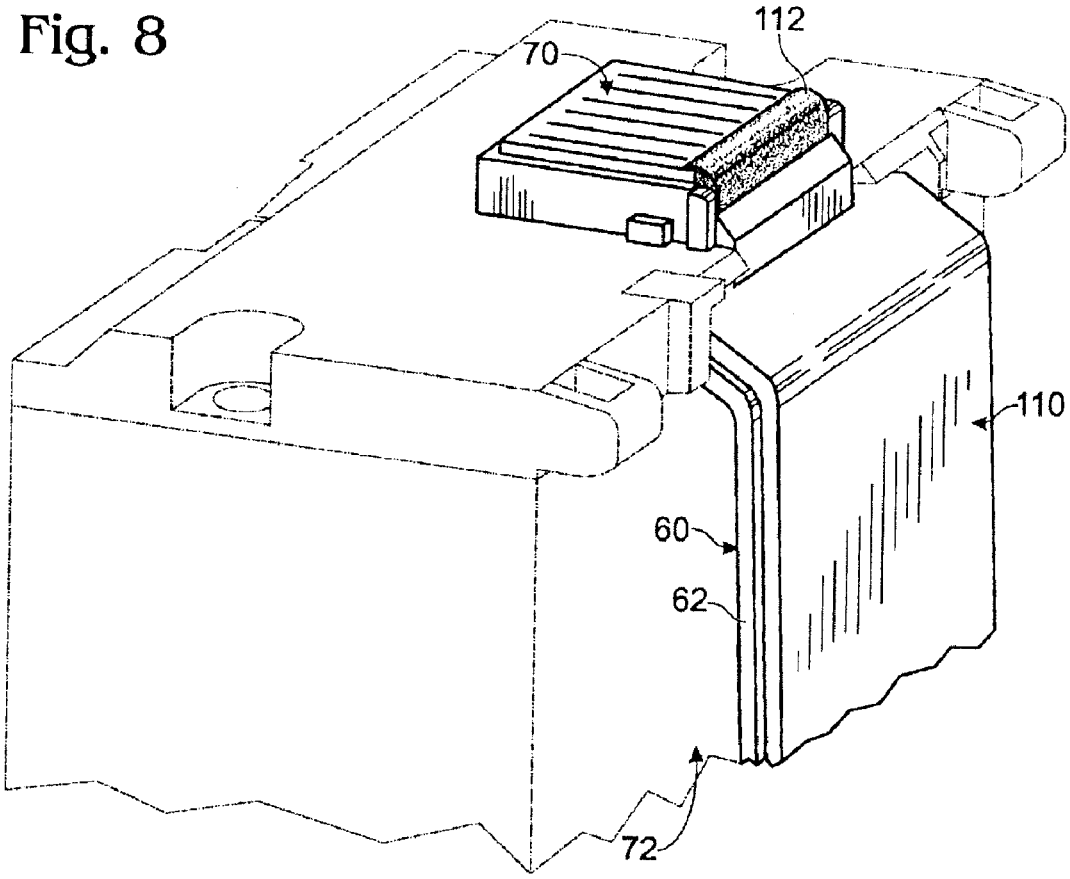
FIG. 8 is an isometric view of another embodiment of a fluid-ejection assembly with an overmolding.

In FIG. 7, the overmolding is illustrated as covering the perimeter of the fluid-ejection head, the circuit pattern defined on the rigid substrate, and the interface therebetween. FIG. 8 shows another example in which an overmolding 110 shields a circuit pattern defined on a rigid substrate. In FIG. 8, a coating 112 is used to shield the interface between the fluid-ejection head and the interconnect. It is within the scope of this disclosure to utilize these and other combinations of overmoldings and other materials for providing protection. In general, conductive traces, wires, and/or other charge paths may be shielded from degenerative substances by overmoldings, coatings, pastes, and/or other substances, as well as combinations thereof.

Although the present disclosure has been provided with reference to the foregoing operational principles and embodiments, it will be apparent to those skilled in the art that various changes in form and detail may be made without departing from the spirit and scope defined in the appended claims. The present disclosure is intended to embrace all such alternatives, modifications and variances. Where the disclosure or claims recite "a," "a first," or "another" element, or the equivalent thereof, they should be interpreted to include one or more such elements, neither requiring nor excluding two or more such elements.

What is claimed is:

1. A fluid-ejection assembly, comprising:

an ejection-head carrier;

an ejection head configured to eject a fluid based on a received ejection signal;

a substantially-rigid, nonconductive substrate configured to be positioned in a substantially fixed relationship relative to the ejection head, wherein the substantially-rigid, nonconductive substrate is molded to follow a contour of the ejection-head carrier; and a conductive pattern defined on the substantially-rigid, nonconductive substrate and configured to convey the ejection signal to the ejection head.

2. The fluid-ejection assembly of claim 1, wherein the substantially-rigid, nonconductive substrate forms at least a portion of an ejection-head carrier.

3. The fluid-ejection assembly of claim 1, wherein the conductive pattern includes photo imaged conductive traces.

4. The fluid-ejection assembly of claim 1, wherein the conductive pattern includes laser patterned conductive traces.

5. The fluid-ejection assembly of claim 1, wherein the conductive pattern includes a three-dimensional circuit pattern.

6. The fluid-ejection assembly of claim 1, wherein the ejection head includes at least one nozzle and a fluid ejector corresponding to the nozzle, and wherein the fluid ejector is configured to eject fluid through the nozzle responsive to the ejection signal.

7. The fluid-ejection assembly of claim 1, wherein the fluid includes ink.

8. The fluid-ejection assembly of claim 1, further including an off-axis ink reservoir.

9. The fluid-ejection assembly of claim 1, further including an on-axis ink reservoir.

10. A fluid-ejection assembly, comprising:

an ejection head configured to eject a fluid based on a received ejection signal;

a substantially-rigid, nonconductive substrate configured to be positioned in a substantially fixed relationship relative to the ejection head, wherein the substantially-rigid, nonconductive substrate includes at least one of liquid-crystal polymer, syndiotactic polystyrene, acrylonitrile-butadlene-styrene, polycarbonate, and polyphenylene oxide; and a conductive pattern defined on the substantially-rigid, nonconductive substrate and configured to convey the ejection signal to the ejection head.

11. A fluid-ejection assembly, comprising:

an ejection head configured to eject a fluid based on a received ejection signal;

a substantially-rigid, nonconductive substrate configured to be positioned in a substantially fixed relationship relative to the ejection head; and a conductive pattern defined on the substantially-rigid, nonconductive substrate and configured to convey the ejection signal to the ejection head, wherein the conductive pattern includes a plurality of conductive traces having a line width between approximately 0.001 inches and 0.005 inches.

12. A fluid-ejection assembly, comprising:

an ejection head configured to eject a fluid based on a received ejection signal;

a substantially-rigid, nonconductive substrate configured to be positioned in a substantially fixed relationship relative to the ejection head; and a conductive pattern defined on the substantially-rigid, nonconductive substrate and configured to convey the ejection signal to the ejection head, wherein the conductive pattern includes a plurality of conductive traces having a line spacing between approximately 0.001 inches and 0.005 inches.

13. A fluid-ejection assembly, comprising:

an ejection head configured to eject a fluid based on a received ejection signal;

a substantially-rigid, nonconductive substrate configured to be positioned in a substantially fixed relationship relative to the ejection head;

a conductive pattern defined on the substantially-rigid, nonconductive substrate and configured to convey the ejection signal to the ejection head; and an overmolding configured to shield at least a portion of the conductive pattern.

14. The fluid-ejection assembly of claim 13, wherein the overmolding includes at least one of poly(ethyiene terephthalate), glycol, liquid-crystal polymer, poly (phenylene sulfide), and poly(cyclohexyiene dimethylene terephthalate), acid.

15. An electrical interconnect, comprising:

a substantially-rigid, nonconductive substrate shaped to mate with an ejection-head carrier so that the substantially-rigid, nonconductive substrate follows a contour of the ejection head carrier and is positionally substantially fixed relative to the ejection-head carrier; and a conductive pattern defined on the substantially-rigid, nonconductive substrate;

wherein the conductive pattern is configured to convey an electrical signal to an ejection head.

16. The electrical interconnect of claim 15, wherein the substantially-rigid, nonconductive substrate is injection molded.

17. An electrical interconect, comprising:

a substantially-rigid, nonconductive substrate shaped to mate with an ejection-head carrier so that the substantially-rigid, nonconductive substrate is positionally substantially fixed relative to the ejection-head carrier;

a conductive pattern defined on the substantially-rigid, nonconductive substrate, wherein the conductive pattern is configured to convey an electrical signal to an ejection head; and an overmolding configured to shield at least a portion of the conductive pattern.

18. An electrical interconnect, comprising:

a substantially-rigid, nonconductive substrate that is molded to follow a contour of an ejection-head carrier; and a conductive pattern defined on the substantially-rigid, nonconductive substrate;

wherein the conductive pattern is configured to convey an electrical signal to an ejection head.

19. An electrical interconnect, comprising:

an injection molded, substantially-rigid, nonconductive substrate that forms at least a portion of an ejection-head carrier; and a conductive pattern defined on the substantially-rigid, nonconductive substrate, wherein the conductive pattern is configured to convey an electrical signal to an ejection head.

20. An electrical interconnect, comprising:

a substantially-rigid, nonconductive substrate that forms at least a portion of an ejection-head carrier;

a conductive pattern defined on the substantially-rigid, nonconductive substrate, wherein the conductive pattern is configured to convey an electrical signal to an ejection head; and an overmolding configured to shield at least a portion of the conductive pattern.

21. A print cartridge, comprising:

a printhead carrier;

a printhead configured to eject ink onto a print medium based on a received print signal;

a substantially-rigid, nonconductive substrate configured to be positioned in a fixed relationship relative to the printhead; and a conductive pattern defined on the substantially-rigid, nonconductive substrate and configured to convey the print signal to the printhead, wherein the substantially-rigid, nonconductive substrate is molded to follow a contour of the printhead carrier.

22. The print cartridge of claim 21, wherein the substantially-rigid, nonconductive substrate forms at least a portion of a printhead carrier.

23. The print cartridge of claim 21, further comprising an on-axis ink reservoir.

24. The print cartridge of claim 21, further comprising an ink inlet configured to receive ink from an off-axis ink reservoir.

25. A print cartridge, comprising:

a printhead configured to eject ink onto a print medium based on a received print signal;

a substantially-rigid, nonconductive substrate configured to be positioned in a fixed relationship relative to the printhead; and a conductive pattern defined on the substantially-rigid, nonconductive substrate and configured to convey the print signal to the printhead; and an overmolding configured to shield at least a portion of the conductive pattern.

26. A method of manufacturing a fluid-ejection cartridge, comprising:

forming a substantially-rigid, nonconductive substrate by molding the substantially-rigid, nonconductive substrate to follow a contour of an ejection-head carrier;

defining a conductive pattern on the nonconductive substrate;

positioning the nonconductive substrate in a fixed relationship relative to an ejection head; and electrically coupling the conductive pattern to the ejection head.

27. A method of manufacturing a fluid-ejection cartridge, comprising:

forming a substantially-rigid, nonconductive substrate by molding the substantially-rigid, nonconductive substrate to form at least a portion of an ejection-head carrier;

defining a conductive pattern on the nonconductive substrate;

positioning the nonconductive substrate in a fixed relationship relative to an ejection head; and electrically coupling the conductive pattern to the ejection head.

28. The method of claim 27, wherein forming the substantially-rigid, nonconductive substrate includes injection molding the substantially-rigid, nonconductive substrate.

29. The method of claim 27, wherein defining a conductive pattern on the nonconductive substrate includes plating the nonconductive substrate with a conductive material and selectively removing portions of the conductive material.

30. The method of claim 29, wherein removing portions of the conductive material includes photo imaging the conductive pattern.

31. The method of claim 29, wherein removing portions of the conductive material includes laser patterning the conductive pattern.

32. A method of manufacturing a fluid-ejection cartridge, comprising:

forming a substantially-rigid, nonconductive substrate;

defining a conductive pattern on the nonconductive substrate;

positioning the nonconductive substrate in a fixed relationship relative to an ejection head;

electrically coupling the conductive pattern to the ejection head; and overmolding at least a portion of the conductive pattern.

33. A fluid-ejection assembly, comprising:

an ejection head configured to eject a fluid based on a received ejection signal;

a fluid ejection head carrier a substantially-rigid substrate molded to follow a contour of the fluid ejection head carrier and configured to be positioned in a substantially fixed relationship relative to the ejection head; and a conductive pattern defined on the substantially-rigid substrate and configured to convey the ejection signal to the ejection head, wherein the conductive pattern has a plurality of electrically isolated traces.

* * * * *